US008733329B2

(12) United States Patent
Sailer et al.

(10) Patent No.: US 8,733,329 B2
(45) Date of Patent: May 27, 2014

(54) MOTOR VEHICLE HAVING AN EXHAUST GAS SYSTEM

(75) Inventors: Uwe Sailer, Sinsheim (DE); Hubert Vollmer, Sao Paulo (BR)

(73) Assignee: Audi AG, Ingolstadt (DE)

( * ) Notice: Subject to any disclaimer, the term of this patent is extended or adjusted under 35 U.S.C. 154(b) by 645 days.

(21) Appl. No.: 13/014,101

(22) Filed: Jan. 26, 2011

(65) Prior Publication Data

US 2011/0225959 A1 Sep. 22, 2011

(30) Foreign Application Priority Data

Jan. 27, 2010 (DE) ..... 10 2010 005 784

(51) Int. Cl.
*F02B 47/08* (2006.01)
*F02M 25/07* (2006.01)

(52) U.S. Cl.
USPC ..... 123/568.12; 60/309

(58) Field of Classification Search
USPC ..... 123/568.11, 568.12; 60/309; 165/231, 165/913
See application file for complete search history.

(56) References Cited

U.S. PATENT DOCUMENTS 2,087,411 A * 7/1937 Lundquist ..... 60/279
3,831,377 A * 8/1974 Morin ..... 60/274
6,301,888 B1 10/2001 Gray, Jr.
6,367,256 B1 * 4/2002 McKee ..... 60/605.2
7,302,795 B2 * 12/2007 Vetrovec ..... 60/309
7,451,750 B1 * 11/2008 Fox et al. ..... 123/568.12
2005/0223702 A1 * 10/2005 Riquelme ..... 60/310
2009/0241515 A1 * 10/2009 Cardno ..... 60/278
2010/0242928 A1 * 9/2010 Fasold et al. ..... 123/568.12
2011/0023842 A1 * 2/2011 Kurtz ..... 123/568.12
2011/0079002 A1 * 4/2011 Siuchta ..... 60/309

FOREIGN PATENT DOCUMENTS

DE 102005050133 A1 4/2006
EP 1548269 A1 6/2005

* cited by examiner

*Primary Examiner* — Willis R Wolfe, Jr.
*Assistant Examiner* — Anthony L Bacon
(74) *Attorney, Agent, or Firm* — Novak Druce Connolly Bove + Quigg LLP

(57) ABSTRACT

The invention relates to a motor vehicle having an internal combustion engine and an exhaust gas system, which comprises an exhaust gas line by means of which the exhaust gas can be removed from the internal combustion engine, as well as an exhaust gas recirculation line by means of which the exhaust gas can be recirculated into the internal combustion engine from the exhaust gas line. The exhaust gas recirculation line has an exhaust gas cooler and a condensate line for removing the condensate from the recirculated exhaust gas, wherein the condensate line is connected with a first end to the exhaust gas recirculation line downstream of the exhaust gas cooler in the direction of flow of the exhaust gas and with a second end to the exhaust gas line. When the motor vehicle is running, the back pressure at the first end of the condensate line is equal to the back pressure at the second end of the condensate line, so that any condensation water that accumulates can be removed without the exhaust gas flowing back into the exhaust gas line from the exhaust gas recirculation line. As an alternative, a closure element for closing the condensate line can be provided. Both variants provide a simple method for removing the condensation water without any necessity for expensive condensate traps or collecting tanks.

6 Claims, 1 Drawing Sheet

MOTOR VEHICLE HAVING AN EXHAUST GAS SYSTEM

The invention relates to a motor vehicle having an exhaust gas system including a recirculating line

BACKGROUND OF THE INVENTION

In order to decrease the emission of nitrogen oxides, modern motor vehicles often have an exhaust gas system with exhaust gas recirculation. In such exhaust gas systems a proportional quantify of the exhaust gas generated by an internal combustion engine of the motor vehicle is recirculated to the intake air of the internal combustion engine. The mixture of intake air and exhaust gas has a lower oxygen content than the pure intake air as a result of which the combustion temperature in the internal combustion engine is lowered. The result of the lower combustion temperature is a decrease in the oxidation of nitrogen during the combustion process, thus lowering the production of environmentally harmful nitrogen oxides.

In gasoline engines, exhaust gas recirculation can also result in a redaction in the specific fuel consumption in partial load mode. The lower oxygen content of the mixture in the internal combustion engine allows the throttle valve to stay open longer in partial load mode, so that back pressure losses that reduce the efficiency of the internal combustion engine are eliminated at the throttle valve.

An especially good effect of exhaust gas recirculation is obtained, when the recirculated exhaust gas is cooled by means of an exhaust gas recirculation cooler, because as the exhaust gas cools down, its density increases. Since the combustion of hydrocarbons produces, besides $CO_2$, significant quantities of water vapor, the situation may arise that the vapor condenses as the exhaust gas cools down, so that liquid water collects in the exhaust gas system.

If, additionally, the charge air is compressed before entering into the internal combustion engine, then the condensed water can flow into the compressor from the exhaust gas recirculation line. Owing to the high rotational speeds of modern compressors, the result may be corrosion or total destruction of the compressor.

In order to avoid the aforesaid, the condensed water has to be removed from the exhaust gas recirculation line. EF 1 548 269 A1 discloses an exhaust gas system wherein a condensate trap is used to separate the water from an exhaust gas recirculation cooler of the exhaust gas system. Such condensate traps are complicated in design as well as difficult and expensive to manufacture.

As an alternative to the use of condensate traps, the exhaust gas recirculation line can also have a collecting tank in which the condensed water collects. A drain line can deliver the water from the collecting tank to the environment or can recirculate it into the exhaust gas line. An exhaust gas system with such a collecting tank is known from U.S. Pat. No. 4,055,158. In such an exhaust gas system, not only the collected water but also a sizable portion of the exhaust gas to be recirculated flows through the drain line, so that the effect of the exhaust gas recirculation is reduced.

Thus, the object of the present invention is to provide a motor vehicle that makes it possible to remove the condensed water from the recirculated exhaust gas in an especially simple and efficient way.

SUMMARY OF THE INVENTION

The invention provides that when the exhaust gas system of such a motor vehicle is running, the back pressure is essentially identical at both ends of a condensate line for removing the condensed water from an exhaust gas recirculation line. This uniformity in pressure can be obtained by adapting various geometric parameters of the exhaust gas system, for example, through a suitable choice of the flow cross section of the condensate line in relation to the flow cross section of the exhaust gas recirculation line or more specifically an exhaust gas line to which the condensate line is connected. Furthermore, the angle at which the condensate line empties into the exhaust gas line or the exhaust gas recirculation line influences the pressure conditions at the ends of the condensate line.

Since there is essentially no pressure gradient along a condensate line that is designed in such a way, very little or no exhaust gas flows from the exhaust gas recirculation line through the condensate line back into the exhaust gas line. Only water, which condenses out of the exhaust gas in an exhaust gas cooler, is drained from the exhaust gas recirculation line via the condensate line and delivered by way of the exhaust gas line to the environment so that sensitive components of the exhaust gas system are protected against damage caused by the liquid water. In order to promote a reliable drainage of the condensed water, it is especially practical to configure the geometry of the condensate line in such a way that in operation a minimal exhaust gas current flows from the exhaust gas recirculation line through the condensate line to the exhaust gas line and entrains any condensed water that has accumulated. It is possible to dispense with collecting tanks exhibiting a high design space requirement and technically complex condensate traps, so that such an exhaust gas system has a low design space requirement and is cost effective.

In an alternative embodiment, the exhaust gas system of the motor vehicle according to the invention has a closure element, winch closes the condensate line in a closing position and releases the condensate line in an opening position. Such a closure element can be brought temporarily into the opening position in order to drain the condensate and then following drainage of the condensate can be closed again. Since in such an exhaust gas system, the condensate line is opened for only short periods of time, the exhaust gas losses through the condensate line are not a major factor. This embodiment, too, makes it possible to dispense with complex condensate traps and collecting tanks that exhibit a high design space requirement.

Preferably, the closure element is configured as a flap. Said flap is a mechanically very simple and compact embodiment that can be integrated into existing exhaust gas systems without having to make significant changes.

It is especially practical to mount the closure element on the first end of the condensate line. An arrangement or this type is designed to promote good flow and to prevent back pressure losses in the exhaust gas line.

An especially preferred embodiment provides a control unit by means of which the closure element can be moved between the opening and closing position at defined time intervals and/or on overshooting or undershooting a specified quantity of condensate in the exhaust gas system. The time-dependent control of the closure element constitutes an especially easy to implement a variant that ensures reliable drainage of the condensed water from the exhaust gas system, so that additional sensors or the like are not necessary. If an especially reliable removal of condensate is to be guaranteed, then it is also possible, nevertheless, to detect the quantity of water that has accumulated in the exhaust gas recirculation line and to control the closure element as a function of the quantity of water. This embodiment is especially applicable to exhaust gas systems with ultra-high quality components.

The following aspects of the invention can be used in conjunction with the two above-described alternative variants of the invention.

It is especially advantageous if in the installation position of the exhaust gas system a connecting area between the exhaust gas recirculation line and the condensate line is arranged at the lowest point of the exhaust gas circulation line in relation to the vertical direction of the vehicle. In the exhaust gas recirculation line, any condensed water that accumulates will collect at this point merely as a result of gravity and can, therefore, drain through the condensate line without any active assistance.

Furthermore, an especially reliable drainage of the condensation water can be obtained if this connecting area is arranged in a bend of the exhaust gas recirculation line. At the lowest point of this bend, water can collect without the risk that water droplets will be dragged into the internal combustion engine or a compressor. This embodiment is especially useful if the condensate line is to be provided with a closure flap that is controlled as a function of time.

In another preferred embodiment of the invention, a connecting area between the second end of the condensate line and the exhaust gas line is arranged downstream of a connecting area between the exhaust gas recirculation line and the exhaust gas line in the flow direction of the exhaust gas. The water that is brought into the exhaust gas line through the condensate line can be reliably delivered to the environment through the exhaust gas line without running the risk that the water will be recirculated again into the exhaust gas recirculation line from the exhaust gas line.

The invention provides preferably an additional closure element by means of which a partial flow cross section of the exhaust gas cooler can be closed. As a function of the operating and ambient conditions of the internal combustion engine, the temperature of the recirculated exhaust gas can be adjusted by changing the flow cross section of the exhaust gas cooler. In this case, it is especially advantageous to prevent the exhaust gas from cooling down too rapidly, because such a sudden drop in temperature would result in excessive condensation of water in the exhaust gas recirculation line.

The invention and its embodiments are explained in detail below with reference to the drawings.

DETAILED DESCRIPTIONS OF THE PREFERRED EMBODIMENTS

Figure 2:
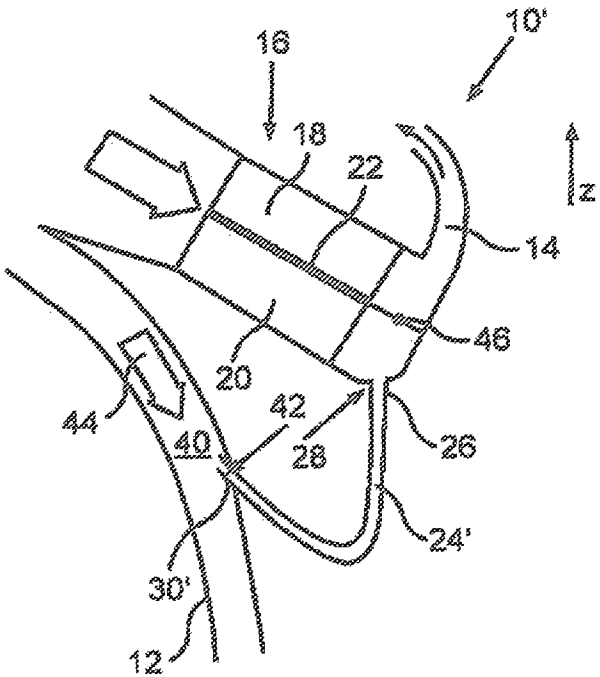
FIG. 1 is a schematic drawing of an embodiment of an exhaust gas system for a motor vehicle according to the invention and FIG. 2 is a schematic drawing of an alternative embodiment of an exhaust gas system for a motor vehicle according to the invention.

An exhaust gas system designated as a whole as 10 for a motor vehicle comprises an exhaust gas line 12 by means of which the exhaust gas can be discharged from an internal combustion engine (not illustrated in the figures) of the motor vehicle. In order to reduce the nitrogen oxide emissions, a proportional quantity of the exhaust gas is recirculated into an intake system of the internal combustion engine via an exhaust gas recirculation line 14. The recirculation of the essentially oxygen-free exhaust gas reduces the oxygen content of the combustion air in the internal combustion engine, thus reducing the combustion temperature and simultaneously producing less nitrogen oxides during the combustion process.

In order to increase the density of the recirculated exhaust gas, tire exhaust gas recirculation line 14 has an exhaust gas cooler 16. This cooler comprises two heat exchangers 18, 20, which can be separated from each other with a partition 22 and through which the exhaust gas can flow in parallel.

Cooling the exhaust gas in the exhaust gas cooler 16 may lead to the condensation of the water vapor contained in the exhaust gas. This condensation is especially deleterious if the recirculated exhaust gas also passes through a compressor before entering into the internal combustion engine. Such a compressor may be damaged by water droplets.

In order to separate the condensed water from the recirculated exhaust gas, the exhaust gas system 10 has a condensate line 24, which connects the exhaust gas recirculation line 14 to the exhaust gas line 12. A first end 26 of the condensate line empties into the exhaust gas recirculation line 14 in a connecting area 28, which is located downstream of the exhaust gas cooler 16 in the direction of flow of the exhaust gas. A second end 30 of the condensate line empties into the exhaust gas line 12 in a connecting area 32, which is located downstream of a connecting area 34 between the exhaust gas recirculation line 14 and the exhaust gas line 12 in the direction of flow of the exhaust gas.

In the installation position of the exhaust gas system, the connecting area 28 is located at the lowest point of the exhaust gas recirculation line 14 in relation to the vertical direction z of the vehicle. Thus, any water that condenses in the exhaust gas cooler 16 collects in the connecting area 28 due to gravity.

In order to prevent the recirculated exhaust gas from flowing back into the exhaust gas line 12 from the exhaust gas recirculation line 14 via the condensate line 24, the end 26 of the condensate line 24 is closed by a flap 35, which is hinged to a wall 38 of the exhaust gas recirculation line 14 by means of a hinge 36. Only after water has collected in the area 28 of the exhaust gas recirculation line 14 is the flap 35 opened, so that the water can drain through the condensate line 24. From the condensate line 24, the water passes over into the exhaust gas line 12 and is entrained by the exhaust gas that is flowing through and delivered to the environment. As a alternative to opening the flap 35 as a function of the water accumulation, the flap 35 can also be opened periodically for short periods of time, so that there is no need for sensors for detecting the condensed water.

FIG. 2 shows an alternative embodiment of an exhaust gas system, which is designated as a whole as 10'. Identical components are provided with the same reference numerals as in the embodiment from FIG. 1. This variant of the invention also provides that a partial exhaust gas flow is tapped from the exhaust gas line 12, cooled in an exhaust gas cooler 16, and recirculated to the internal combustion engine by way of an exhaust gas recirculation line 14.

Figure 1:
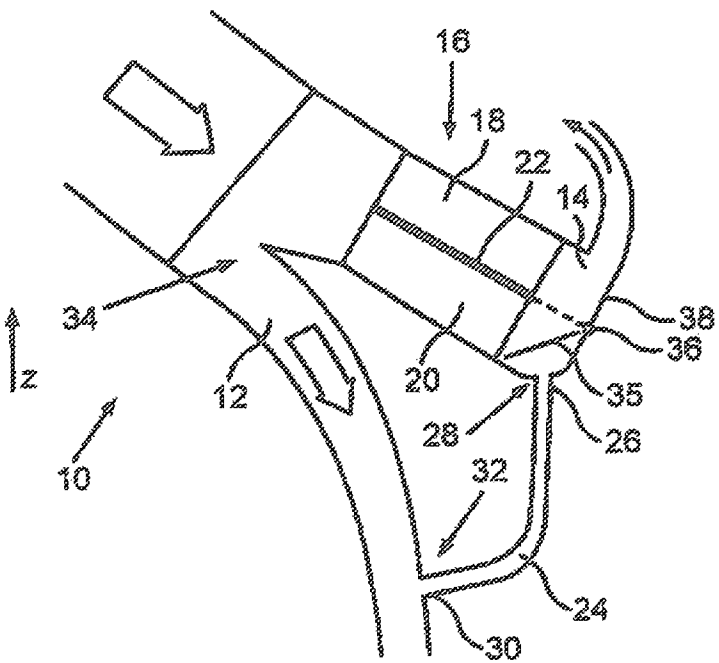

The embodiment from FIG. 1 snows a condensate line 24', by means of which condensed water can be drained into the exhaust gas line 12 from the exhaust gas recirculation tine 14.

In contrast to the embodiment according to FIG. 1, the exhaust gas system 10' does not have a flap for closing the condensate line 24'. Rather, the back flow of the exhaust gas from the exhaust gas recirculation line 14 into the exhaust gas line 12 is prevented by the design of the condensate line 24' itself.

Analogous to the embodiment according to FIG. 1, the first end 26 of the condensate line 24' is connected to the exhaust gas recirculation line in a connecting area 28. However, in this case the second end 28' of the condensate line extends into an interior 40 of the exhaust gas line 12, wherein an orifice 42 of the condensate line 24' is oriented in the opposite direction to the direction of flow (illustrated by the arrow 44) of the exhaust gas in the exhaust gas line 21.

The exhaust gas flowing through the exhaust gas line 12 generates a back pressure at the orifice 42 of the condensate line 24'. This back pressure is equivalent to approximately the back pressure in the connecting area 28 of the exhaust gas recirculation line 14 with the condensate line 24'. Since there is no pressure gradient over the run of the condensate line 24', no exhaust gas can flow from the exhaust gas recirculation line 14 through the condensate line 24' back into the exhaust gas line 12. Therefore, in this case, there is no need for a flap to close the condensate line 24'. However, the condensed water can still drain solely subject to the effect of gravity from the exhaust gas recirculation line 14 through the condensate line 24' into the exhaust gas line 2.

The exhaust gas system 10' comprises a flap 46, by means of which the heat exchanger 20 can be closed, so that the recirculated exhaust gas flows only through the heat exchanger 18. Therefore, the cooling capacity of the exhaust gas cooler 16 drops when the flap 46 is closed. On passing through the exhaust gas cooler, the recirculated exhaust gas has a higher temperature, as a result of which the condensation of water from the recirculated exhaust gas is reduced. At low operating temperatures, for example, when the internal combustion engine is running under partial load, this state can be utilized to eliminate the accumulation of water in the exhaust gas recirculation line 14. Such a flap 46 can also be used in the embodiment according to FIG. 1, where it is not depicted in the drawing for the sake of a better overview.

The invention claimed is:

1. In a motor vehicle provided with an internal combustion engine including an exhaust gas line, an exhaust gas recirculation line connected to said exhaust gas line and communicable with said engine, and means disposed in said exhaust gas recirculation line for cooling recirculated exhaust gas, a condensed vapor removal device comprising a curved line directly interconnecting said exhaust gas recirculation line at a point downstream of said cooling means and said exhaust gas line, postured to cause said condensed vapor to gravity flow thereinto, wherein at least one of the variances in the cross sections and the angular displacement of the flow paths of the ends of said interconnecting line relative to adjoining exhausts regeneration and exhaust gas lines, function to produce substantially equal back pressures at the ends of said interconnecting line upon operation of said engine.

2. A condensate removal device according to claim 1 wherein an inlet of said condensate removal line is disposed at a lowest point of said recirculation line downstream of said cooling means.

3. A condensate removal device according to claim 1 including a remotely operable valve disposed at the juncture of said condensate removal line and said recirculation line.

4. A condensate removal device according to claim 3 wherein said valve comprises a flapper valve.

5. A condensate removal device according to claim 1 wherein said condensate removal line is curved in a vertical plane, inducing a flow of condensate into said exhaust gas line upon occurrence of a head portion in the upstream section of a column of condensate disposed in said condensate removal line.

6. A condensate removal device according to claim 1 including a pair of cooling means disposed in said recirculation line wherein said recirculation line includes a remotely operable valve disposed downstream of one of said cooling means and an inlet of said condensate line, and a portion of said recirculation line downstream of said other cooling means.

* * * * *